US011217170B2

(12) United States Patent
Gao

(10) Patent No.: US 11,217,170 B2
(45) Date of Patent: Jan. 4, 2022

(54) PIXEL-DRIVING CIRCUIT AND DRIVING METHOD, A DISPLAY PANEL AND APPARATUS

(71) Applicant: BOE Technology Group Co., Ltd., Beijing (CN)

(72) Inventor: Xueling Gao, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 284 days.

(21) Appl. No.: 16/494,549

(22) PCT Filed: Mar. 6, 2019

(86) PCT No.: PCT/CN2019/077189
§ 371 (c)(1),
(2) Date: Sep. 16, 2019

(87) PCT Pub. No.: WO2020/093633
PCT Pub. Date: May 14, 2020

(65) Prior Publication Data

US 2021/0358397 A1 Nov. 18, 2021

(30) Foreign Application Priority Data

Nov. 5, 2018 (CN) ..... 201811309885.8

(51) Int. Cl.
*G09G 3/325* (2016.01)
*G09G 3/3266* (2016.01)

(52) U.S. Cl.
CPC ..... *G09G 3/325* (2013.01); *G09G 3/3266* (2013.01); *G09G 2300/0819* (2013.01);
(Continued)

(58) Field of Classification Search
CPC ..... G09G 3/325; G09G 3/3266; G09G 2300/0819; G09G 2310/066; G09G 2300/0852; G09G 2320/045
See application file for complete search history.

(56) References Cited

U.S. PATENT DOCUMENTS

2008/0224965 A1* 9/2008 Kim ..... G09G 3/3233 345/76
2011/0285691 A1 11/2011 Taro et al.
(Continued)

FOREIGN PATENT DOCUMENTS

CN 106297662 A 1/2017
CN 106531074 A 3/2017
(Continued)

OTHER PUBLICATIONS

First Office Action in the Chinese Patent Application No. 201811309885.8, dated Oct. 12, 2020; English translation attached.

*Primary Examiner* — Premal R Patel
(74) *Attorney, Agent, or Firm* — Intellectual Valley Law, P.C.

(57) ABSTRACT

A pixel-driving circuit includes a driving sub-circuit with at least one transistor and one capacitor coupled to a light-emitting device. The pixel-driving circuit further includes an initialization sub-circuit coupled to the light-emitting device and configured to initialize the light-emitting device with a initialization signal under control of a scan signal. Additionally, the pixel-driving circuit includes a data-input sub-circuit coupled to the driving sub-circuit and configured to write the data signal to the driving sub-circuit under control off scan signal. Furthermore, the pixel-driving circuit includes an emission-control sub-circuit having two transistors of different types and one capacitor coupled to the driving sub-circuit and the light-emitting device and configured to control the driving sub-circuit to output a driving
(Continued)

current based on the data signal under control of a control signal and a reference-voltage signal.

20 Claims, 11 Drawing Sheets

(52) U.S. Cl.
CPC ..... *G09G 2300/0852* (2013.01); *G09G 2310/066* (2013.01); *G09G 2320/045* (2013.01)

(56) References Cited

U.S. PATENT DOCUMENTS

| | | | | |
|---|---|---|---|---|
| 2013/0088417 | A1* | 4/2013 | Kim ..... | G09G 3/3233 345/82 |
| 2017/0200417 | A1 | 7/2017 | Wu et al. | |
| 2017/0270867 | A1 | 9/2017 | Zhu et al. | |
| 2018/0226018 | A1 | 8/2018 | Han | |

FOREIGN PATENT DOCUMENTS

| | | | |
|---|---|---|---|
| CN | 106782313 | A | 5/2017 |
| CN | 107393478 | A | 11/2017 |
| CN | 109147648 | A | 1/2019 |
| KR | 20130075429 | A | 7/2013 |

* cited by examiner

PIXEL-DRIVING CIRCUIT AND DRIVING METHOD, A DISPLAY PANEL AND APPARATUS

CROSS-REFERENCE TO RELATED APPLICATION

This application is a national stage application under 35 U.S.C. § 371 of International Application No. PCT/CN2019/077189 filed Mar. 6, 2019, which claims priority to Chinese Patent Application No. 201811309885.8, filed Nov. 5, 2018, the contents of which are incorporated by reference in the entirety.

TECHNICAL FIELD

The present invention relates to display technology, more particularly, to a pixel-driving circuit and driving method, and a display panel and apparatus implementing the method.

BACKGROUND

Organic Light Emitting Diode (OLED) display is one of the hotspots in the field of flat panel display research today. Unlike Thin Film Transistor-Liquid Crystal Display (TFT-LCD), which uses a stable voltage to control brightness, OLED is driven by a driving current required to be kept constant to control illumination. The OLED display panel includes a plurality of pixel units configured with pixel-driving circuits arranged in multiple rows and columns. Each pixel-driving circuit includes a driving transistor having a gate terminal connected to one gate line per row and a drain terminal connected to one data line per column. When the row in which the pixel unit is gated is turned on, the switching transistor connected to the driving transistor is turned on, and the data voltage is applied from the data line to the driving transistor via the switching transistor, so that the driving transistor outputs a current corresponding to the data voltage to an OLED device. The OLED device is driven to emit light of a corresponding brightness.

SUMMARY

In an aspect, the present disclosure provides a pixel-driving circuit. The pixel-driving circuit includes a driving sub-circuit coupled to a light-emitting device. The pixel-driving circuit further includes an initialization sub-circuit coupled to the light-emitting device. The initialization sub-circuit is configured to receive a scan signal and an initialization signal, and to initialize the light-emitting device with the initialization signal under control of the scan signal. Additionally, the pixel-driving circuit includes a data-input sub-circuit coupled to the driving sub-circuit. The data-input sub-circuit is configured to receive the scan signal and a data signal, and to write the data signal to the driving sub-circuit under control of the scan signal. Furthermore, the pixel-driving circuit includes an emission-control sub-circuit coupled to the driving sub-circuit and the light-emitting device. The emission-control sub-circuit has two transistors of different types configured to receive a control signal and a reference-voltage signal, and to control the driving sub-circuit to output a driving current based on the data signal and the reference-voltage signal under control of the control signal.

Optionally, the emission-control sub-circuit includes a first transistor, a second transistor, and a first capacitor. The first transistor has a first control terminal configured to receive the control signal, a first terminal coupled to the driving sub-circuit, and a second terminal coupled to a first terminal of the first capacitor. The second transistor has a second control terminal configured to receive the control signal, a first terminal configured to receive the reference-voltage signal, and a second terminal coupled to the first terminal of the first capacitor. The first capacitor has a second terminal coupled to a first terminal of the light-emitting device which has a second terminal configured to connect with a second power supply.

Optionally, the two transistors of different types are either N-type transistor or P-type transistor.

Optionally, the driving sub-circuit includes a driving transistor and a second capacitor. The driving transistor has a control terminal coupled to a first terminal of the second capacitor and the first terminal of the first transistor. The driving transistor has a first terminal coupled to the light-emitting device. The driving transistor has a second terminal couple to a first power supply. The second capacitor has a second terminal coupled to the first terminal of the first capacitor.

Optionally, the driving transistor is a N-type transistor.

Optionally, the data-input sub-circuit includes a third transistor having a first terminal configured to receive the data signal, a second terminal coupled to the control terminal of the driving transistor, and a control terminal configured to receive the scan signal.

Optionally, the third transistor is a same type as the second transistor.

Optionally, the initialization sub-circuit includes a fourth transistor having a first terminal configured to receive the initialization signal, a control terminal configured to receive the scan signal, and a second terminal coupled to the light-emitting device.

Optionally, the fourth transistor is the same type as the second transistor.

Optionally, the driving current is provided to be a driving-transistor factor multiplying a square of a voltage difference between an amplitude of the reference-voltage signal and an amplitude of the data signal, and to be substantially independent from a threshold voltage and a drain-terminal voltage of the driving transistor.

Optionally, the amplitude of the reference-voltage signal is set to be larger than a maximum value among amplitudes of different data signals received at various times.

In another aspect, the present disclosure provides a display panel having a plurality of scan lines and a plurality of data lines. The display panel includes a plurality of pixel-driving circuits described herein. A respective one of the pixel-driving circuits is coupled to a respective one of the scan lines to receive a scan signal and coupled to a respective one of the data lines to receive a data signal. The display panel further includes a light-emitting device having a first terminal coupled to the respective one of the pixel-driving circuits and a second terminal configured to connect with a second power supply.

In yet another aspect, the present disclosure provides a display apparatus including a display panel described herein.

In still another aspect, the present disclosure provides a method for driving a pixel-driving circuit. The method includes, in a first period, writing voltages associated with a data signal and a reference-voltage signal respectively to a second capacitor under control of a scan signal and a control signal. Additionally, the method includes, in a second period, writing voltages associated with the data signal, the reference-voltage signal, and a threshold voltage of a driving transistor to a first capacitor under control of the scan signal and the control signal. Furthermore, the method includes, in a third period, applying a combination of voltages associated with the data signal, the reference-voltage signal, and the threshold voltage of the driving transistor to across a gate terminal and a source terminal of the driving transistor under control of the control signal to provide a driving current from the driving transistor to a light-emitting device. The driving current is depended on the voltages associated with the data signal and the reference-voltage signal.

Optionally, in a first period, the step of writing voltages includes turning a third transistor on under control of the scan signal to write a voltage associated with the data signal to a first terminal of the second capacitor. The step of writing voltages further includes turning a second transistor on under control of the control signal to write a voltage associated with the reference-voltage signal to a second terminal of the second capacitor. Additionally, the step of writing voltages includes turning a fourth transistor on under control of the scan signal to write a voltage associated with an initialization signal to a first terminal of the light-emitting device.

Optionally, in a second period, the step of writing voltages includes turning a first transistor off and a second transistor on under control of the control signal to write a voltage associated with the data signal minus the threshold voltage of the driving transistor to a second terminal of the first capacitor. A first terminal of the first capacitor is at a voltage level same as the voltage associated with the reference-voltage signal at the second terminal of the second capacitor. The step of writing voltages further includes charging the first terminal of the second capacitor to a first voltage depended to the voltage associated with the data signal.

Optionally, in a third period, the step of writing a combination of voltages includes turning a first transistor on and a second transistor off under control of the control signal to short the second capacitor to induce a voltage change of both a first terminal and a second terminal of the second capacitor to a second voltage depended to a voltage associated with the data signal. The step of writing a combination of voltages includes adding the voltage change to the second terminal of the first capacitor above the voltage associated with the data signal minus the threshold voltage of the driving transistor.

Optionally, the voltage associated with the reference-voltage signal includes an amplitude greater than that of the voltage associated with the data signal.

Optionally, the voltage associated with the initialization signal minus a voltage provided by a second power supply is set to be smaller than an emission-threshold voltage of the light-emitting device.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Figure 1:
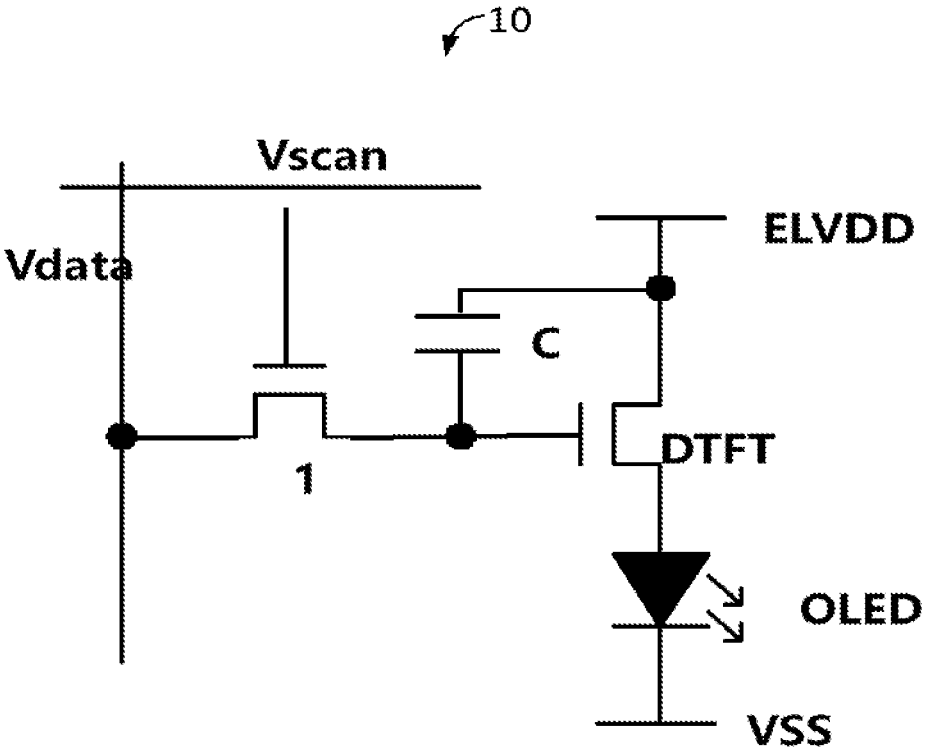
FIG. 1 (related art)
FIG. 1 is a circuitry diagram of a pixel-driving circuit according to a related art.
Figure 2:
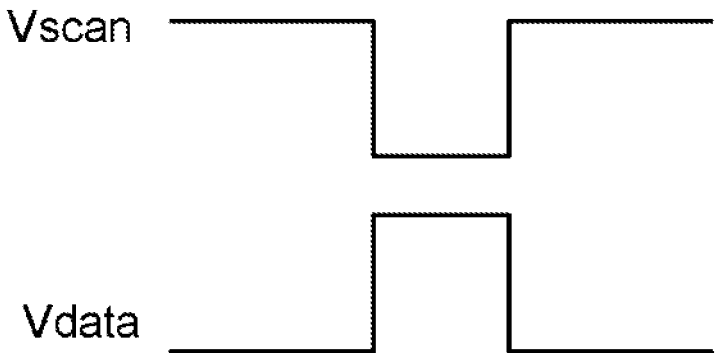
FIG. 2 (related art)
FIG. 2 is a timing waveform diagram for operating the pixel-driving circuit of FIG. 1 according to a related art.

FIG. 1 shows a pixel-driving circuit in a commonly-used 2T1C configuration. The pixel-driving circuit 10 includes a driving transistor DTFT, a switching transistor M1 and a storage capacitor C. In the example shown in FIG. 1, the driving transistor DTFT and the switching transistor M1 are P-type thin-film transistors. As one scan line is scanning a row associated with the pixel-driving circuit 10, a scan signal Vscan is provided as a low-level voltage signal from the scan line. The switching transistor M1 is turned on to allow a voltage associated with a data signal Vdata to be written into the storage capacitor C. When the row where the pixel-driving circuit 10 belongs is finishing the scanning, the scan signal Vscan changes to a high-level voltage signal, turning off the switching transistor M1. The voltage stored in the storage capacitor C is applied to a control terminal of the driving transistor to drive the driving transistor DTFT, which has a first terminal coupled to a power supply ELVDD, to generate a current flowing from the first terminal to a second terminal of the driving transistor. The drain terminal of the driving transistor DTFT is connected to a first terminal of an organic light-emitting diode (OLED). The current from the driving transistor DTFT is used to drive the OLED to ensure continuous light emission display one pixel image, which is just one of all pixel-driving circuits in the display panel for displaying one frame of image.

The current flowing through the driving transistor, or so-called a driving current $I_{oled}$ for driving OLED, can be quantified as a following formula:

$$I_{oled}=K(Vgs-Vth)^2,$$

where K is a parameter depended on process and design of the driving transistor DTFT and will be a constant once the driving transistor DTFT is manufactured; Vgs is a gate-to-source voltage of the driving transistor DTFT; Vth is a threshold voltage of the driving transistor DTFT. Since Vgs=Vdata−ELVDD based on circuitry structure of the pixel-driving circuit 10, $I_{oled}$ can further be expressed as Ioled=K (Vdata−ELVDD−Vth)$^2$.

As seen in the above formula of the driving current generated by the driving transistor DTFT, the driving current $I_{oled}$ is depended on the threshold voltage Vth of the driving transistor and the power supply voltage VDD provided to the first terminal of the driving transistor in a Quadratic relationship. Thus, even with a 0.1 V different in Vth of the driving transistors from one pixel-driving circuit to another, a substantial difference in driving current can be induced. This will cause difference in luminance of the OLEDs in different pixels, resulting in afterimage in the display.

Additionally, because OLED-based pixel-driving circuit is driven by a current with a source from a power supply in which the current is always there once the OLED is activated to emit light. Since the power line laid in the display panel to transport the current from the power supply ELVDD is a metal line, the current flows continuously through the metal line within each unit-time of displaying one frame of image and induces a larger voltage drop as the current flows farther the distance along the metal line. This causes grayscale nonuniformity issue of the display panel in a region near the power supply source versus a farther region. The voltage drop is also called ELVDD IR drop. Both ELVDD fluctuation and IR drop are issues that need to be addressed or minimized if not completely eliminated in designing pixel-driving circuits for the OLED-based display apparatus.

Accordingly, the present disclosure provides, inter alia, a pixel-driving circuit for generating a driving current to be independent from the power supply voltage as well as the threshold voltage of the driving transistor during an emission period of a display panel, a driving method based on the pixel-driving circuit, a display panel and a display apparatus having the same that substantially obviate one or more of the problems due to limitations and disadvantages of the related art.

Figure 3:
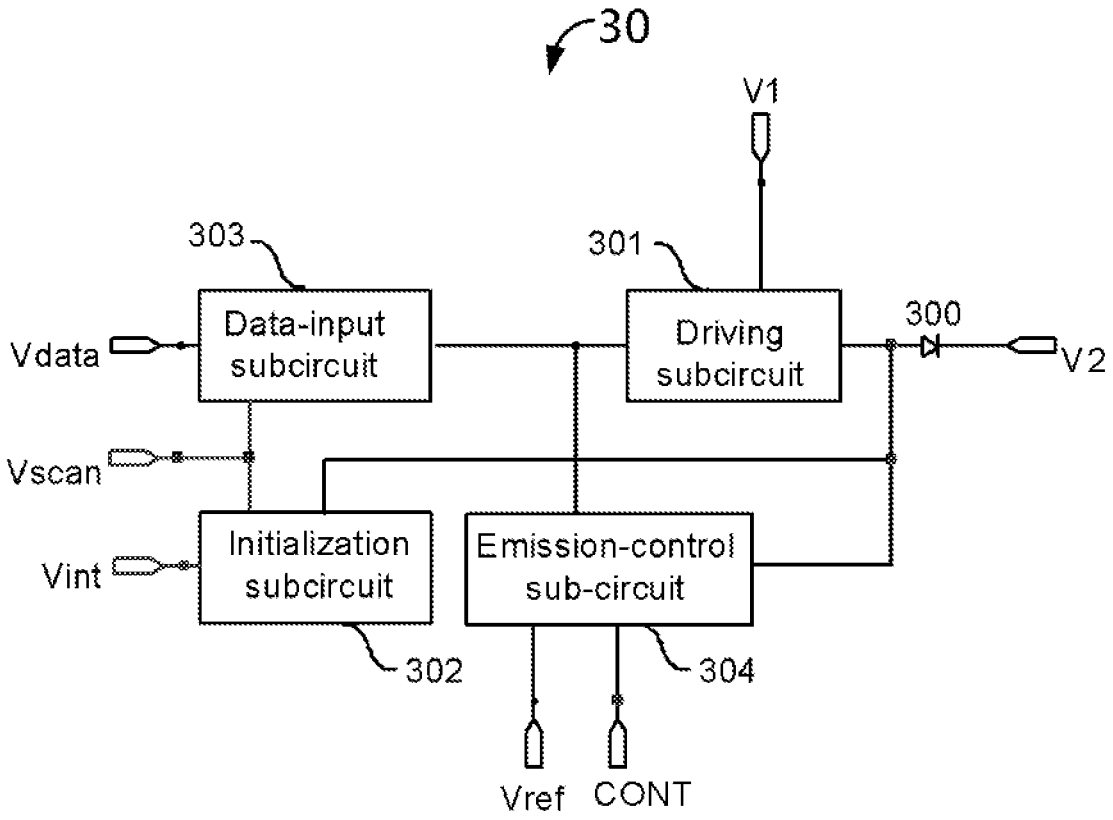
FIG. 3 is a block diagram of a pixel-driving circuit according to some embodiments of the present disclosure.

In one aspect, the present disclosure provides a pixel-driving circuit for a display panel based on active light-emitting devices. For example, the light-emitting device is an organic light-emitting diode (OLED). Of course, the light-emitting device can also be other types of light-emitting device to be covered in the same scope of claims in the disclosure. FIG. 3 shows a block diagram of a pixel-driving circuit according to some embodiments of the present disclosure. Referring to FIG. 3, the pixel-driving circuit 30 includes a driving sub-circuit 301 coupled to the light-emitting device 300. The pixel-driving circuit 30 also includes an initialization sub-circuit 302 coupled to the light-emitting device 300. The initialization sub-circuit 302 is configured to receive a scan signal Vscan and an initialization signal Vint. In an embodiment, the initialization sub-circuit 302 is utilizing the initialization signal Vint to initialize the light-emitting device 300 under control of the scan signal Vscan. For example, one terminal of the light-emitting device 300 is set to a voltage associated with the initialization signal Vint.

Referring to FIG. 3, the pixel-driving circuit 30 further includes a data-input sub-circuit 303 coupled to the driving sub-circuit 301. The data-input sub-circuit 303 is configured to receive the scan signal as well as a data signal Vdata. In an embodiment, the data-input sub-circuit 303 is configured to write a voltage associated with the data signal Vdata to the driving sub-circuit 301.

Referring to FIG. 3, the pixel-driving circuit 30 still includes an emission-control sub-circuit 304 connected to the driving sub-circuit 301 and the light-emitting device 300. The emission-control sub-circuit 304 is configured to receive a control signal CONT and a reference-voltage signal Vref. Further, the emission-control sub-circuit 304 is under control of the control signal CONT to use the reference-voltage signal Vref to control the driving sub-circuit 301 to output a driving current that is depended on the data signal Vdata to the light-emitting device 300.

Figure 4:
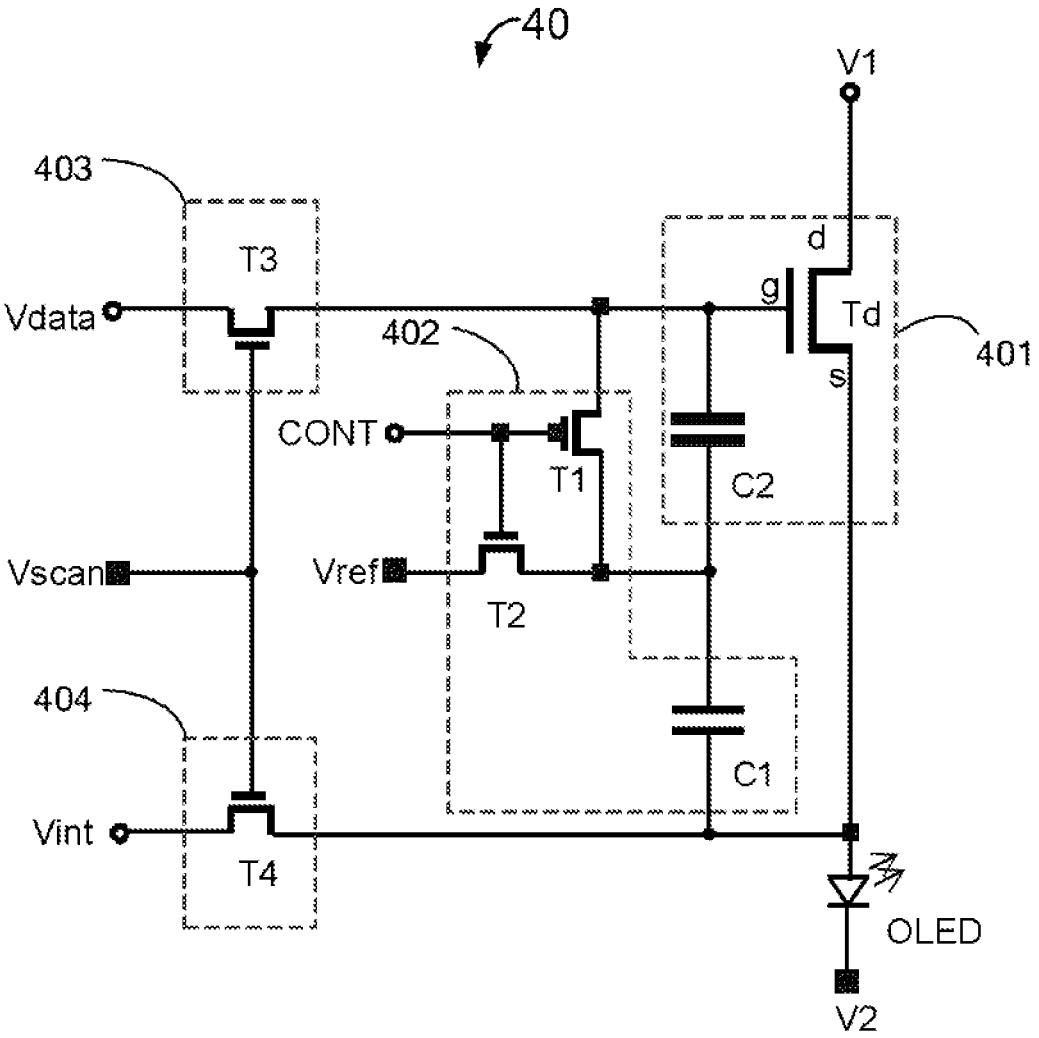
FIG. 4 is a circuitry diagram of a pixel-driving circuit according to an embodiment of the present disclosure.

FIG. 4 is a circuitry diagram of a pixel-driving circuit according to an embodiment of the present disclosure. Referring to FIG. 4, the pixel-driving circuit 40 is an example of pixel-driving circuit 30 and the light-emitting device is an OLED. In the example, a driving sub-circuit 401 of the pixel-driving circuit 40 includes a driving transistor Td and a storage capacitor C2. Optionally, and as shown in FIG. 4, the driving transistor Td is a N-type thin-film transistor, having a control terminal g connected to a first terminal of the storage capacitor C2, a first terminal s connected to a first terminal of the OLED, and a second terminal d connected to a first power supply providing a first voltage V1. Optionally, the control terminal g is a gate terminal, the first terminal s is a source terminal, and the second terminal d is a drain terminal of the N-type transistor Td. A second terminal of the OLED, optionally, is connected to a second power supply providing a second voltage V2. Optionally, the first terminal of the OLED is an anode and the second terminal is a cathode.

In the pixel-driving circuit 40, an emission-control sub-circuit 402 includes a first transistor T1, a second transistor T2, and a capacitor C1. For the convenience of description, the capacitor C1 is referred to the first capacitor and the storage capacitor C2 is referred to the second capacitor. Referring to FIG. 4, the first transistor T1 and the second transistor T2 have a common control terminal configured to receive a control signal CONT. A first terminal of the first transistor T1 is connected to the driving sub-circuit 401. In an embodiment, the first terminal of T1 is connected to the control terminal g of the driving transistor Td. A second terminal of the first transistor T1 is connected to a first terminal of the capacitor C1. A first terminal of the second transistor T2 receives a reference-voltage signal Vref. A second terminal of T2 is connected to the first terminal of C1. A second terminal of C1 is connected to the first terminal of the OLED.

In the example shown in FIG. 4, the first transistor T1 is a P-type transistor and the second transistor T2 is a N-type transistor. Optionally, the first transistor T1 can be one of either a P-type transistor and a N-type transistor and the second transistor T2 can a different type versus the first transistor T1. T1 And T2 have different gate-conducting voltage levels. The control signal CONT is also referred to emission-control signal.

Referring to FIG. 4 again, a data-input sub-circuit 403 of the pixel-driving circuit 40 includes a third transistor T3. A first terminal of the third transistor T3 is configured to receive a data signal Vdata. A second terminal of the third transistor T3 is connected to the control terminal g of the driving transistor Td. A control terminal of the third transistor T3 is configured to receive the scan signal Vscan. Additionally, an initialization sub-circuit 404 of the pixel-driving circuit 40 includes a fourth transistor T4 having a first terminal configured to receive an initialization signal Vint, a control terminal configured to receive the scan signal Vscan, and a second terminal connected to the first terminal of the OLED.

Optionally, the third transistor T3 and the fourth transistor T4 are N-type transistors. Optionally, the third transistor T3 and the fourth transistor T4 are P-type transistors. the third transistor T3 and the fourth transistor T4 are same-type of transistors. Optionally, the third transistor T3 and the fourth transistor T4 are same types of transistors as the second transistor T2.

Figure 5:
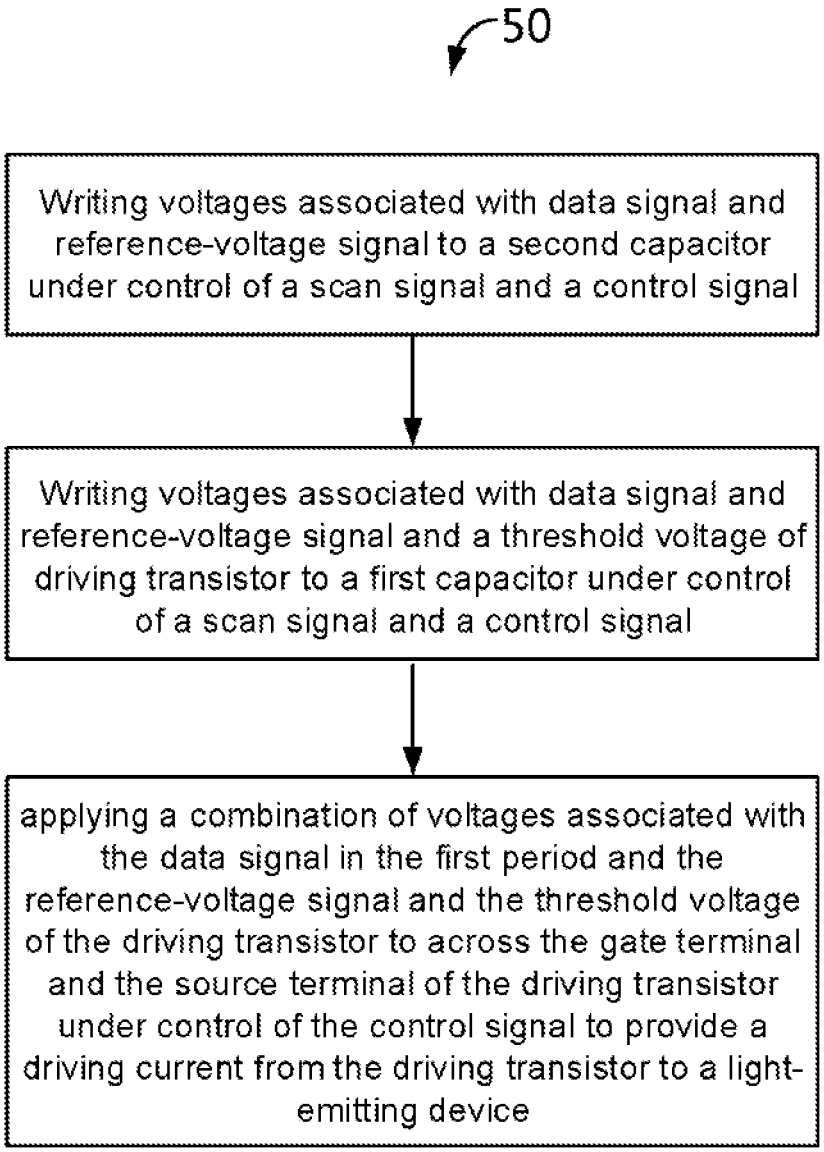
FIG. 5 is a flow chart illustrating a method for driving the pixel-driving circuit of FIG. 4 according to an embodiment of the present disclosure.

In another aspect, the present disclosure provides a driving method for operating the pixel-driving method. FIG. 5 shows a flow chart illustrating a method for driving the pixel-driving circuit of FIG. 4 according to an embodiment of the present disclosure. Referring to FIG. 5, the driving method 50 includes at least several steps executed to operate the pixel-driving circuit described herein within a unit-time of displaying one frame of image, the unit-time including a first period, a second period, and a third period in a sequential order. Optionally, in each period, the method may include more than one steps. Optionally, multiple steps in each period may be executed in different orders.

Referring to FIG. 5 and FIG. 4, the method 50 includes, in the first period, writing voltages associated with a data signal Vdata and a reference-voltage signal Vref to a second capacitor C2 under control of a scan signal Vscan provided in the first period and a control signal CONT received by the pixel-driving circuit of FIG. 4. The method 50 further includes, in the second period, writing the voltage associated with the data signal Vdata in the first period, the voltage associated with the reference-voltage signal Vref, and a threshold voltage Vth of a driving transistor Td in the pixel-driving circuit into a first capacitor C1 under control of the scan signal provided in the second period and a control signal CONT.

Additionally, the method 50 includes, in the third period, applying a combination of the voltage based on the data signal stored in the first capacitor C1, the voltage associated with the reference-voltage signal Vref, and the threshold voltage Vth to the driving transistor Td across its gate terminal and source terminal under control of the control signal CONT. Thus, driving the driving transistor Td to output a driving current, that is depended on the data signal Vdata, to a light-emitting device.

Figure 6:
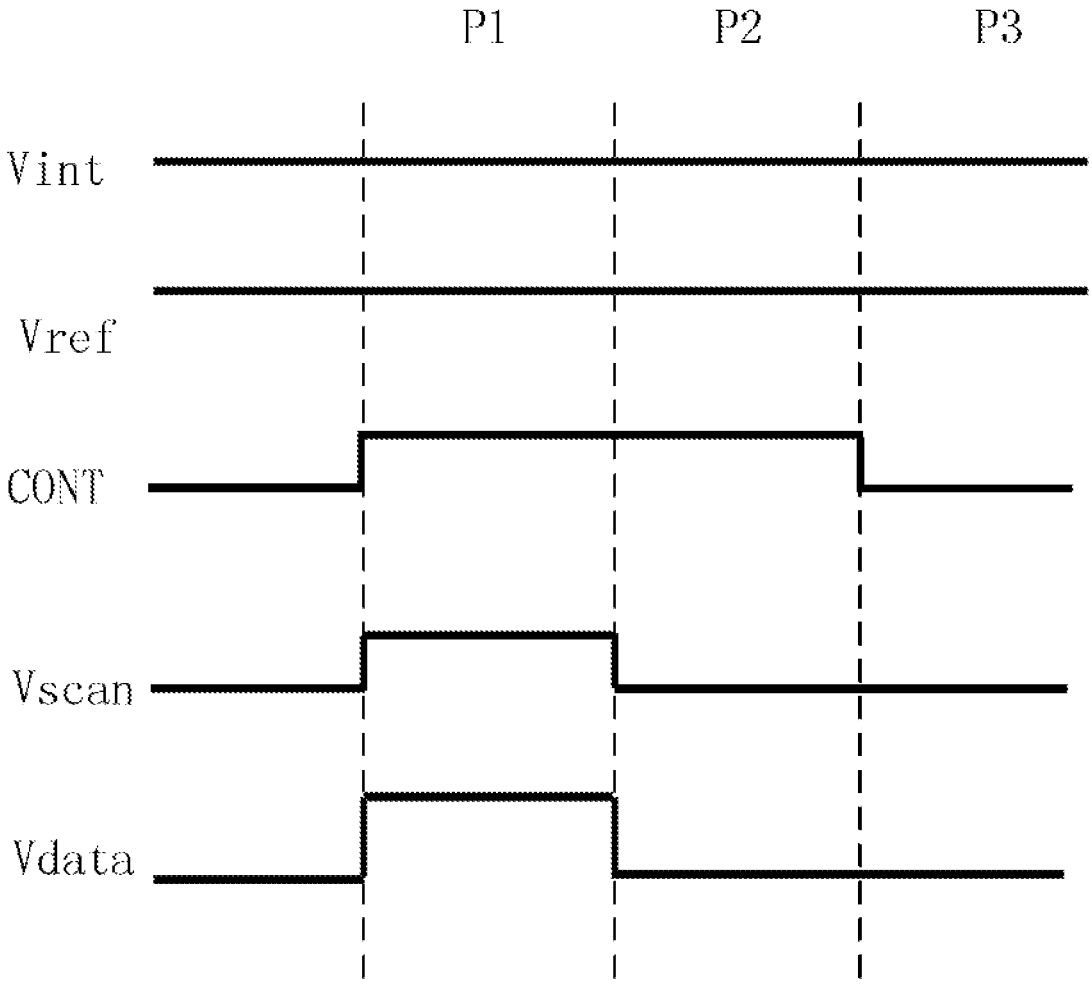
FIG. 6 is a timing waveform diagram of several control signals used for operating the pixel-driving circuit according to the embodiment of the present disclosure.
Figure 7A:
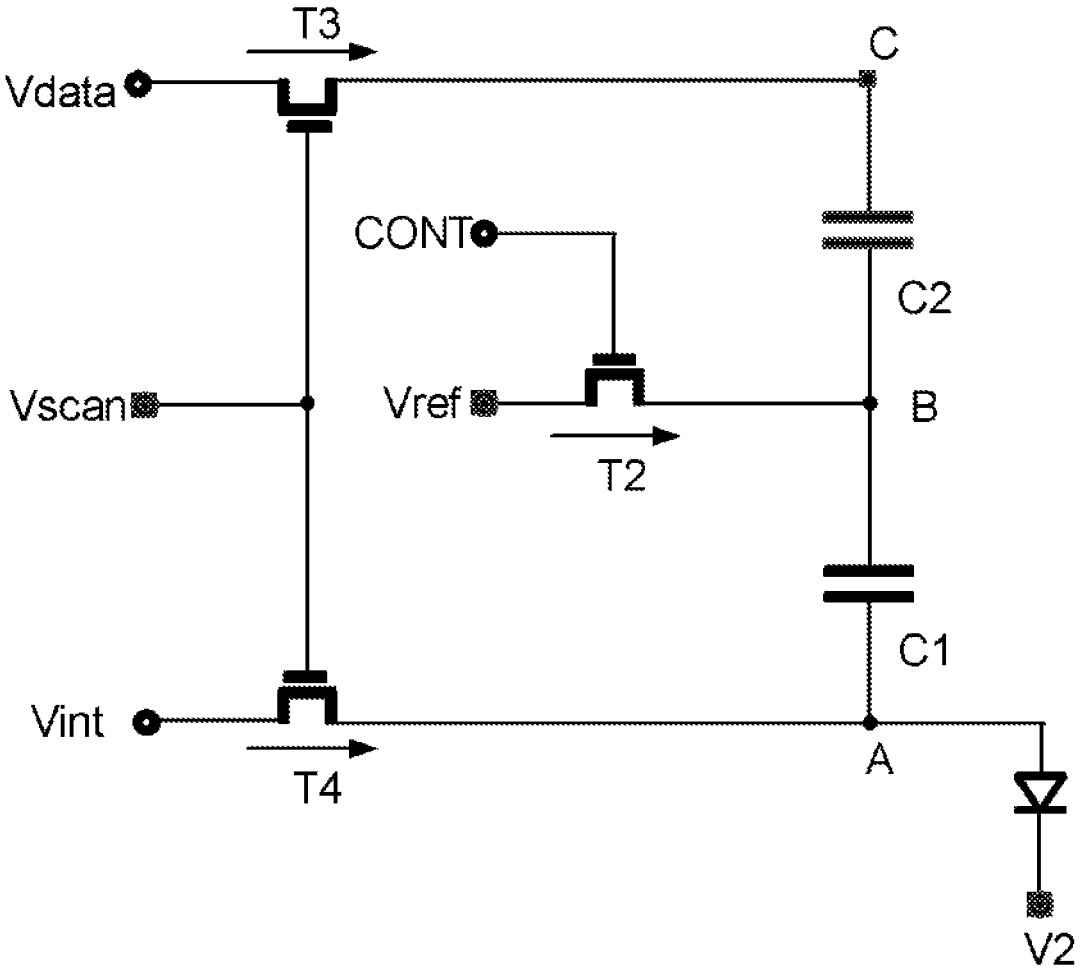
FIG. 7A is a diagram of an effective pixel-driving circuit operated in a first period according to an embodiment of the present disclosure.
Figure 7B:
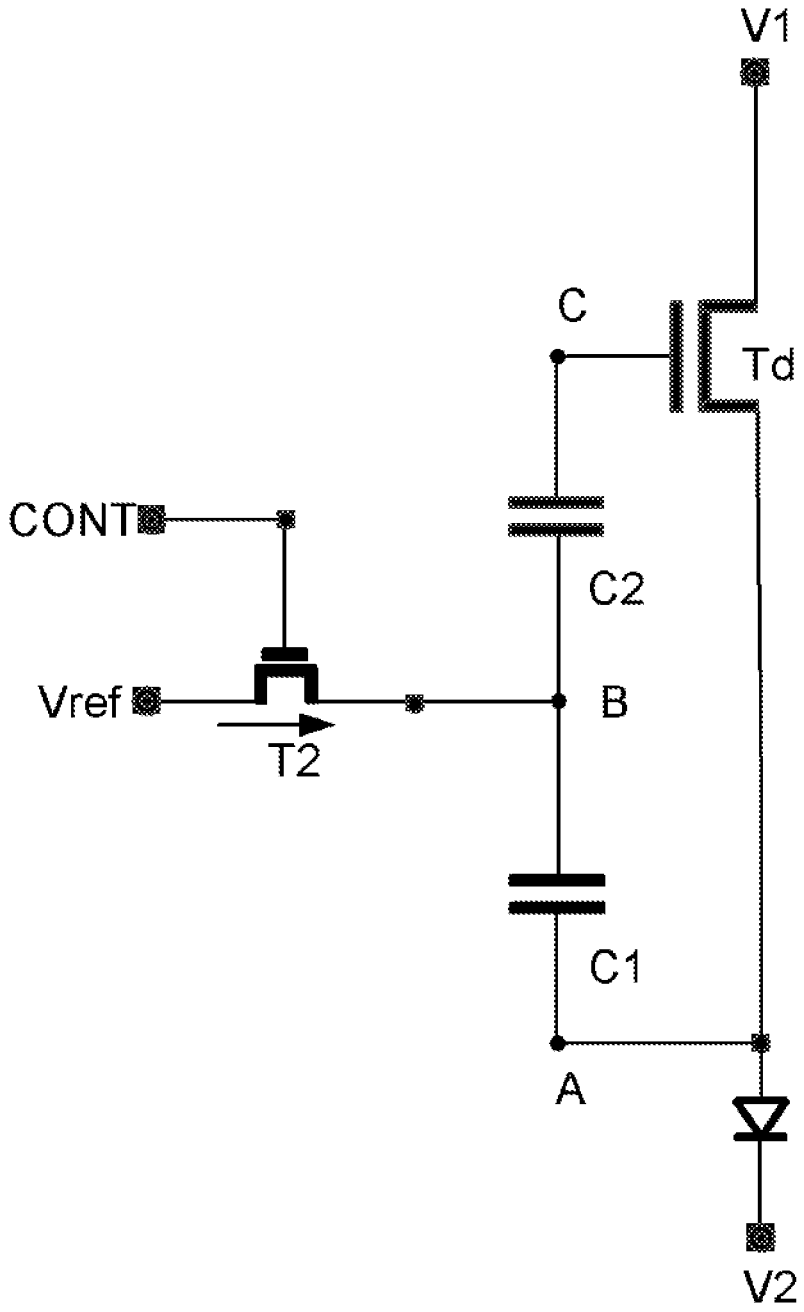
FIG. 7B is a diagram of an effective pixel-driving circuit operated in a second period according to an embodiment of the present disclosure.
Figure 7C:
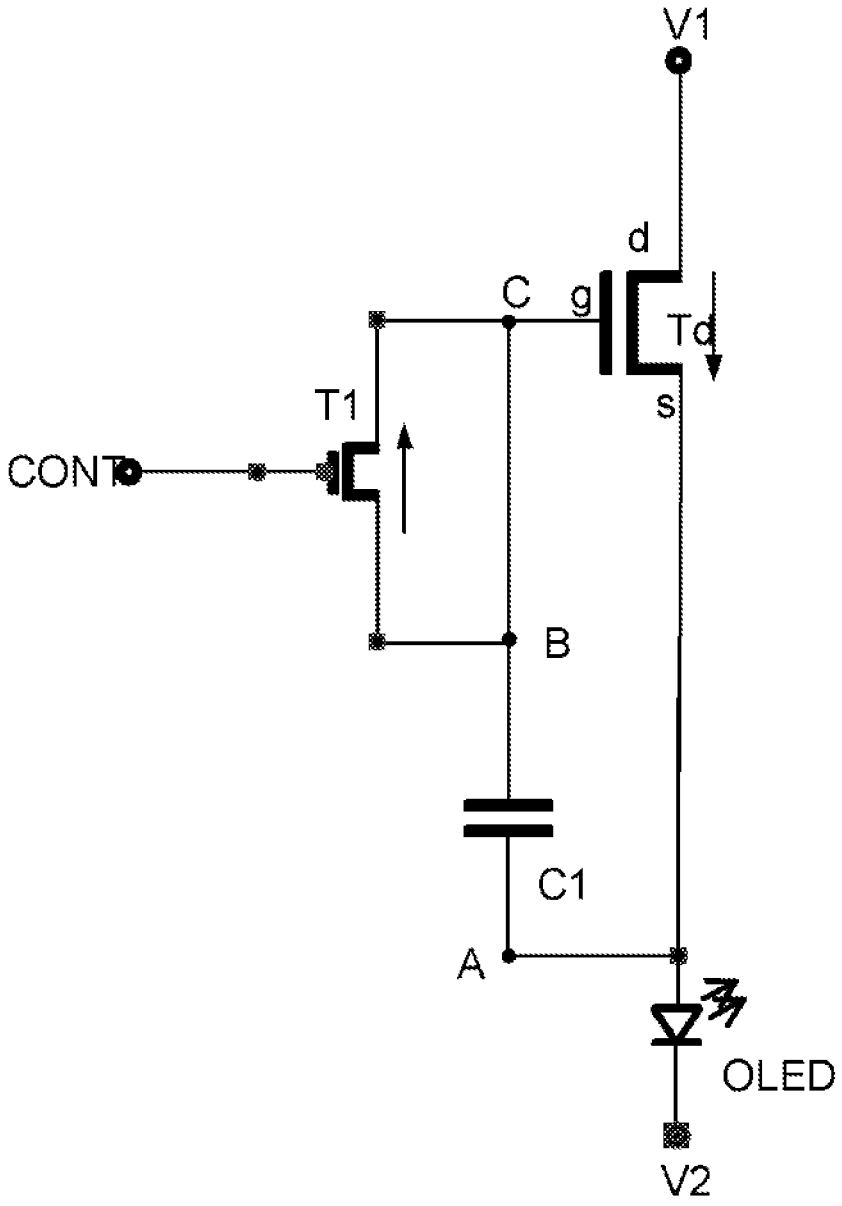
FIG. 7C is a diagram of an effective pixel-driving circuit operated in a third period according to an embodiment of the present disclosure.

FIG. 6 is a timing waveform diagram of several control signals used in the method of FIG. 5 for operating the pixel-driving circuit according to the embodiment of the present disclosure. Under these control signals provided with different levels of voltages in respective different periods, the pixel-driving circuit 40 is operated with different effective circuits. FIG. 7A shows a diagram of an effective circuit of the pixel-driving circuit of FIG. 4 operated in a first period according to an embodiment of the present disclosure. FIG. 7B shows a diagram of an effective circuit of the pixel-driving circuit of FIG. 4 operated in a second period according to an embodiment of the present disclosure. FIG. 7C shows a diagram of an effective circuit of the pixel-driving circuit of FIG. 4 operated in the third period according to an embodiment of the present disclosure.

Referring to FIGS. 4, 6, and 7A, in the first period P1, the control signal CONT is set to a high-level voltage and the scan signal Vscan is set to a high-level voltage. Under control of the control signal CONT, the first transistor T1 in the pixel-driving circuit 40 is turned off and the second transistor T2 is turned on. Under control of the scan signal Vscan, the third transistor T3 and the fourth transistor T4 in the pixel-driving circuit 40 are turned on. As shown in FIG. 7A, the fourth transistor T4 being at an ON state allows an initialization signal Vint is applied to the light-emitting device to initialize its terminal voltage level. In particular, the light-emitting device is an OLED. A voltage associated with the initialization signal Vint is applied to the first terminal of the OLED which has a second terminal connected to the second power supply with a second voltage V2. Optionally, the initialization signal Vint is set so that (Vint−V2) is smaller than an emission threshold voltage $V_{oled}$ of the OLED. With such initialization signal setting, the OLED is ensured that it is not going to emit light during the first period P1. Optionally, the second voltage is provided to be at 0V. Optionally, the Vint may be set to be −3V. The second terminal A of the first capacitor C1 has a voltage level equal to $V_A$=Vint.

Referring to FIG. 7A, the third transistor T3 being at an ON state also allows a voltage (assuming to be a high-level voltage shown in FIG. 6) associated with the data signal Vdata to be written into a node C. Referring to FIG. 4 or 7A, the driving transistor Td is provided as a N-type transistor. The driving transistor Td is turned on by the high-level voltage associated with the data signal Vdata in the first period P1. A first terminal of the second capacitor C2 is the same as the node C connected to the control terminal, i.e., gate terminal, of the driving transistor Td. The voltage level at the node C is $V_C$=Vdata. This sets a basis of effectively writing a threshold voltage Vth of the driving transistor into the second capacitor Td. In the first period P1, the second transistor T2 is at an ON state, a second terminal B of the second capacitor C2 is set to a voltage associated with the reference-voltage signal Vref, so that $V_B$=Vref. Therefore, in the first period P1, the voltage across two terminals of the first capacitor C1 is $V_{C1}=V_A-V_B$=Vint−Vref; the voltage across two terminals of the second capacitor C2 is $V_{C2}=V_B-V_C$=Vref−Vdata. In the first period P1, the pixel-driving circuit is operated to complete an initialization process to store proper voltages across the first capacitor and the second capacitor as well as set proper voltage level across the OLED. The first period P1 is thus referred as an initialization period.

Referring to FIG. 6, in the second period P2, the control signal CONT is provided at a high-level voltage and the scan signal Vscan is provided at a low-level voltage. The first transistor T1 is turned off. The second transistor T2 is turned on. Both the third transistor T3 and the fourth transistor T4 are turned off.

FIG. 7B shows a diagram of an effective circuit of the pixel-driving circuit of FIG. 4 operated under control of signals CONT and Vscan in a second period of FIG. 6 according to an embodiment of the present disclosure. Referring to FIG. 7B, the second transistor T2 is turned on and the voltage level of the node B remains to be $V_B$=Vref. The driving transistor Td is turned on (at least at a beginning of the second period P2 with Vdata being applied to the gate terminal) to allow a charging of node A from the first voltage V1 provided from the first power supply. Since the fourth transistor T4 is turned off, the voltage level $V_A$ of the node A starts to increase from the initialized voltage level of Vint. For the second capacitor C2 stored a voltage across its two terminals, the voltage level $V_C$ of the node C is $V_C$=Vdata at the beginning of the second period P2. A gate-to-source voltage of the driving transistor in this period P2 will be $Vgs=V_g-V, =V_C-V_A$. As the second period P2 proceeds, the voltage level $V_A$ of the node A increases while the gate-to-source voltage Vgs of the driving transistor Td decreases until Vgs becomes smaller than the threshold voltage Vth of the driving transistor Td at which the driving transistor Td is turned off. At this time, the voltage $V_A$ of the node A becomes $V_A$=Vdata−Vth. The voltage level $V_C$ of the node C changes to Vdata1 which is a voltage level related to the voltage associated with the data signal Vdata provided in the first period. When a balance is reached in the second period P2, the voltage across two terminals of the first capacitor C1 becomes $V_{C1}=V_A-V_B$=Vdata−Vth−Vref; the voltage across two terminals of the second capacitor C2 becomes $V_{C2}=V_B-V_C$=Vref−Vdata1. Effectively, the voltage associated with the data signal in the first period is written to the first capacitor C1 in the second period P2, which is also referred to a data-input period.

Referring to FIG. 6, in the third period P3, both the control signal CONT and the scan signal Vscan are provided at low-level voltages. The first transistor T1 is turned on. The second transistor T2, the third transistor T3, and the fourth transistor T4 are all turned off.

FIG. 7C shows a diagram of an effective circuit of the pixel-driving circuit of FIG. 4 operated under control of signals CONT and Vscan in a third period of FIG. 6 according to an embodiment of the present disclosure. Referring to FIG. 7C, since the first transistor T1 is turned on the second capacitor C2 is shorted so the voltage level $V_B$ of the node B quickly changes from original voltage level of Vref in the second period P2 to be equal to the voltage level $V_C$ of the node C, i.e., $V_B=V_C$=Vdata2, in the third period P3. Here Vdata2 is a voltage level related to the voltage associated with the data signal Vdata provided in the first period. Vdata2 allows the driving transistor td to be turned on again. A voltage change $\Delta V_B$ at the node B is yielded: $\Delta V_B$=Vdata2−Vref. Due to a coupling effect of the first capacitor C1, the voltage level $V_A$ of the node A will also change from its level of Vdata−Vth in the second period P2 to Vdata−Vth+$\Delta V_B$=Vdata−Vth+Vdata2−Vref. At this time, the gate-to-source voltage Vgs of the driving transistor Td will also be changed to Vgs=$V_C-V_A$=Vdata2−(Vdata−Vth+Vdata2−Vref)=Vth+Vref−Vdata.

Based on the formula for the driving current $I_{DS}=K(Vgs-Vth)^2$ during a saturate state of the driving transistor Td, the driving current $I_{DS}=K(Vth+Vref-Vdata-Vth)^2=K(Vref-Vdata)^2$. Referring to FIG. 1 and associated description on the driving current flowing through the driving transistor, the parameter K is depended on a specific process and design of the driving transistor Td and will be a constant once it is manufactured.

In an embodiment, an amplitude of the reference-voltage signal Vref is provided to be larger than an amplitude of the data signal Vdata (provided in the first period). In the third period P3, the gate-to-source voltage of the driving transistor Td is given as Vgs=Vth+Vref−Vdata. In order to ensure the light-emitting device to emit light at least in the third period, the gate-to-source voltage Vgs is required to be larger than the threshold voltage Vth, i.e., Vth+Vref−Vdata>Vth. Thus, Vref>Vdata. Any time a respective one of a row of pixel-driving circuits receives a different data signal. At different time, the data signal received by a pixel-driving circuit may also be different. In an embodiment, the voltage value of the reference-voltage signal Vref is set to be greater than a maximum voltage value of all data signals. For example, the voltage value of Vref can be set to be greater than that of a data signal corresponding to greatest grayscale level of 255 (assuming the grayscale range is 0~255). The third period P3 is referred to an emission period as the light-emitting device is driven to emit light in this period.

As seen above, the driving current IDS is independent from the drain terminal voltage V1 (i.e., from the first power supply) and the threshold voltage Vth of the driving transistor Td. Therefore, the pixel-driving circuit according to the present disclosure provides proper compensation to the variations of the threshold voltage Vth and the power supply voltage V1. In the pixel-driving circuit, by using the control signal CONT to control on- or off-state of the first transistor T1 and the second transistor T2, the circuit is effectively changed according to high- or low-level of the control signal CONT. At the same time, by setting the first capacitor C1, the gate-to-source voltage of the driving transistor Td becomes independent from the threshold voltage Vth and the drain terminal voltage V1 of the driving transistor. Then, the pixel luminance non-uniformity issue caused by drifts of the threshold voltage Vth of the driving transistor and the voltage drop of V1 due to back substrate power supply ELVDD can be resolved.

Figure 8:
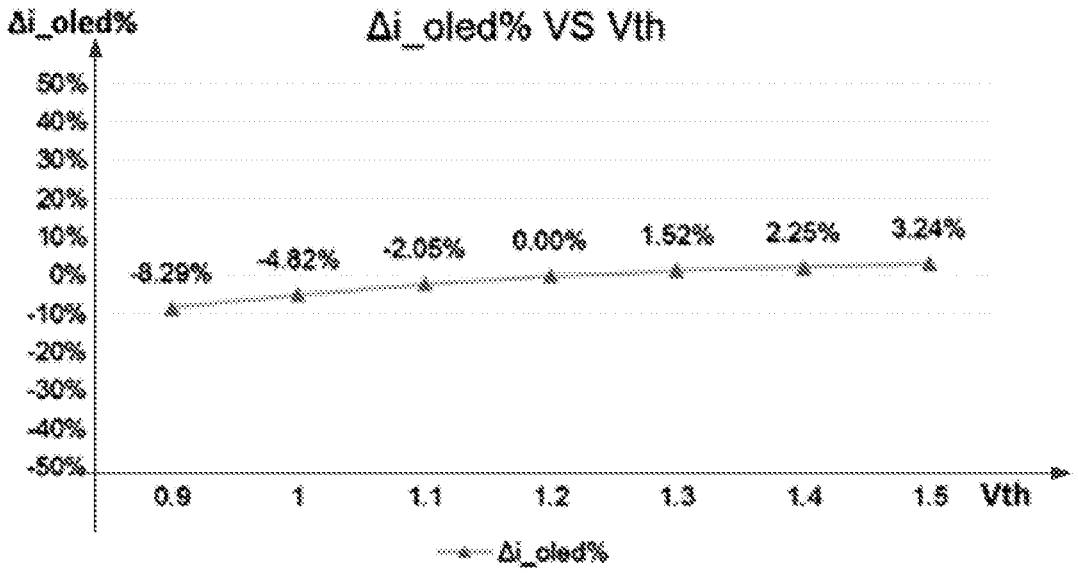
FIG. 8 is a simulation plot of a threshold voltage Vth of a driving transistor versus a current i_oled flown through a light-emitting device based on a pixel-driving circuit according to an embodiment of the present disclosure.

FIG. 8 is a simulation plot of a threshold voltage Vth of a driving transistor versus a current i_oled flown through a light-emitting device based on a pixel-driving circuit according to an embodiment of the present disclosure. Referring to FIG. 8, a simulation test results based on the pixel-driving circuit disclosed in FIG. 4 are presented. By setting the driving transistor Td with different threshold voltage Vth, different values of the driving current i_oled for driving light-emission of the light-emitting device are obtained. Although the artificial drift of Vth is given up to 25%, the change Δi_oled of the driving current i_oled is found to be no greater than 10%. This indicates that the pixel-driving circuit according to the present disclosure properly compensates the drift of the threshold voltage Vth of the driving transistor Td.

Figure 9:
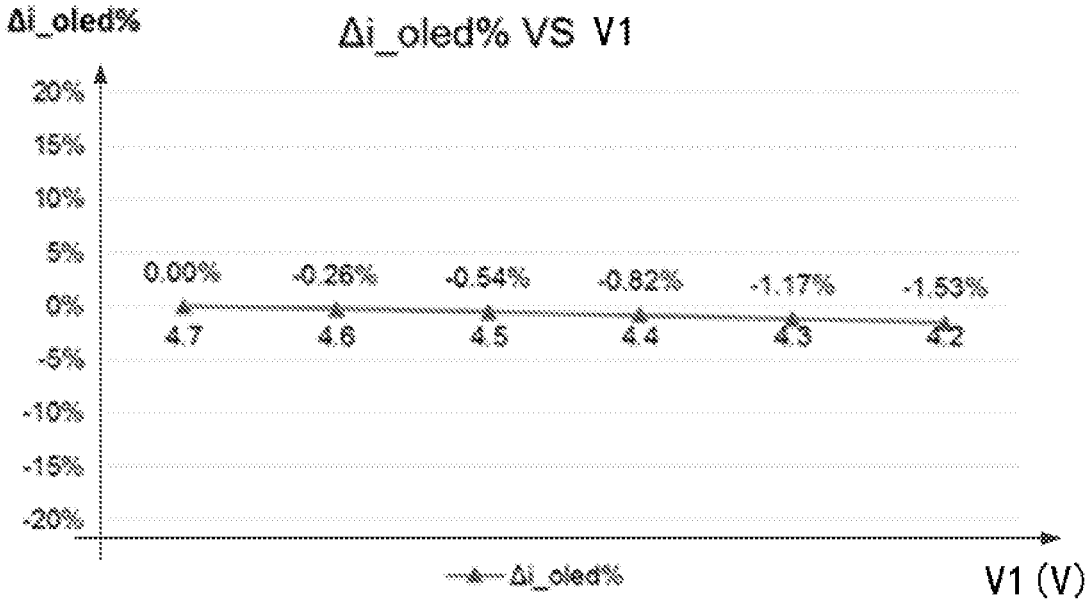
FIG. 9 is a simulation plot of a drain-terminal voltage V1 of a driving transistor versus a current i_oled flown through a light-emitting device based on a pixel-driving circuit according to an embodiment of the present disclosure.

FIG. 9 is a simulation plot of a drain-terminal voltage V1 of a driving transistor versus a current i_oled flown through a light-emitting device based on a pixel-driving circuit according to an embodiment of the present disclosure. Referring to FIG. 8, simulation test results based on the pixel-driving circuit of FIG. 4 are presented. The drain terminal voltage V1 of the driving transistor Td decreases from 4.7 V to 4.2 V, but the driving current change Δi_oled is found to be no greater than 2%. This indicates that the pixel-driving circuit of the present disclosure substantially eliminates the effect of the voltage drop of drain terminal voltage V1 of the driving transistor to the driving current for driving the light-emitting device.

Figure 10:
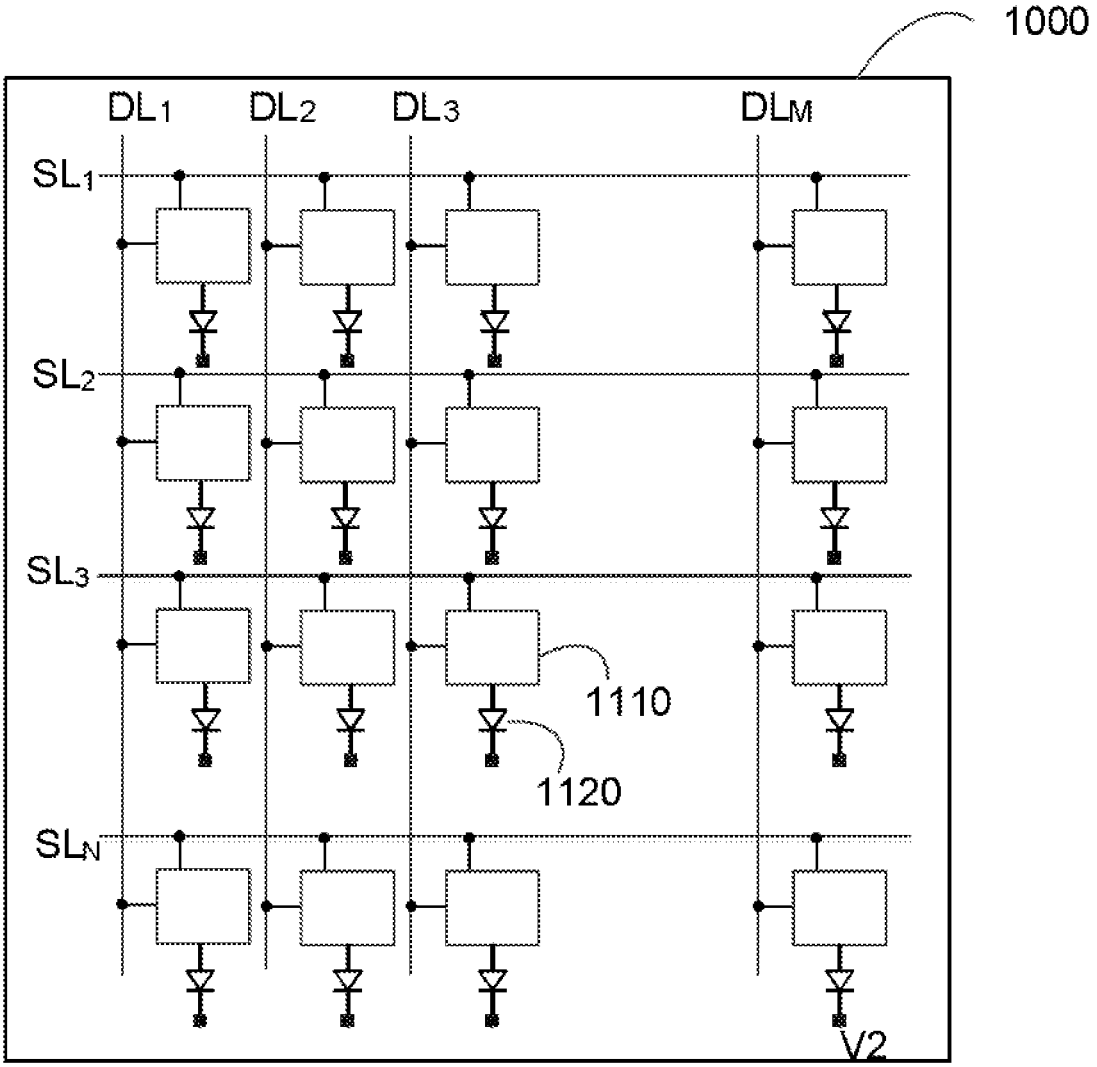
FIG. 10 is a schematic structure diagram of a display panel according to an embodiment of the present disclosure.

In yet another aspect, the present disclosure provides a display panel. FIG. 10 shows a schematic diagram of a pixel panel according to an embodiment of the present disclosure. Referring to FIG. 10, the display panel 1000 includes a plurality of scan lines, including $SL_1$~$SL_N$, laid in multiple rows and configured to provide a scan signal one row at a time following s scanning scheme. The display panel 1000 also includes a plurality of data lines, including $DL_1$~$DL_M$, laid in multiple columns and configured to provide a data signal along a respective data line. Here M and N are positive integers. The display panel additionally includes a plurality of subpixels each having a pixel-driving circuit of one described herein. The plurality of pixel-driving circuits is arranged in a matrix with multiple rows corresponding to the plurality of scan lines and multiple columns corresponding to the plurality of data lines. A pixel-driving circuit 1110 connects a data line and a scan line and a light-emitting device 1120. A first terminal of the light-emitting device 1120 is connected to the pixel-driving circuit 1110 and a second terminal of the light-emitting device is connected to a second power supply with a second voltage V2. Optionally, V2 is a low-level voltage source. Optionally, V2=VSS. Optionally, V2=0V.

Figure 11:
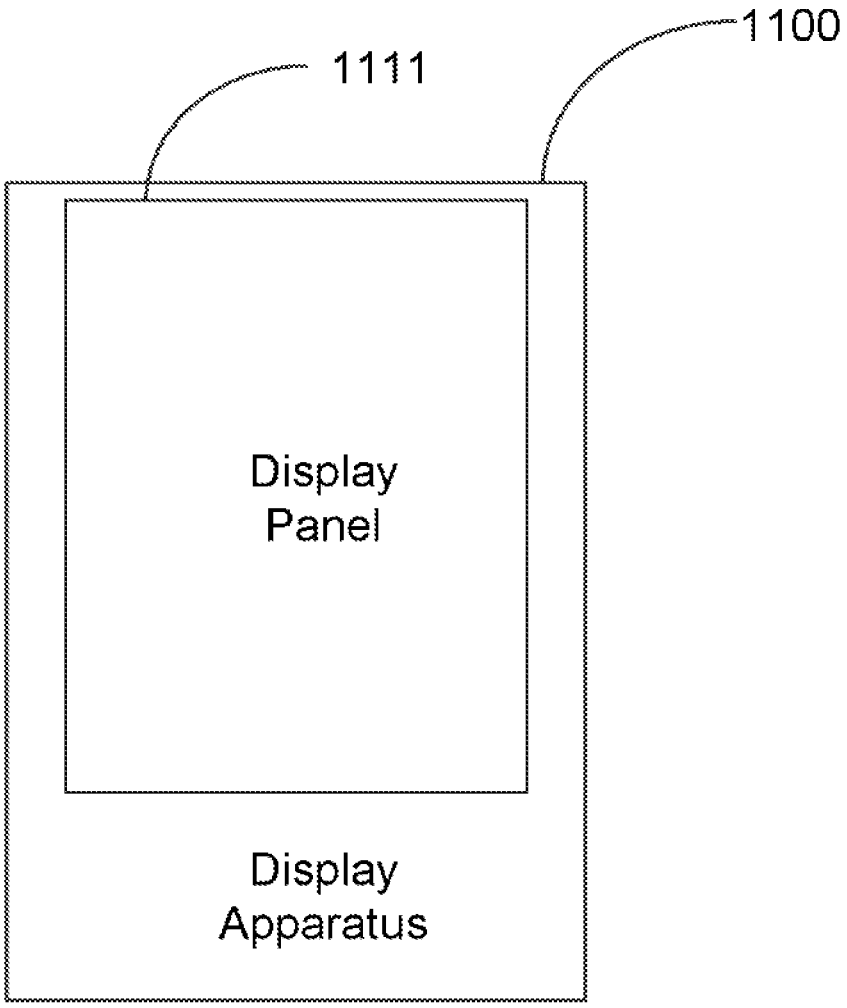
FIG. 11 is a schematic structure diagram of a display apparatus according to an embodiment of the present disclosure.

In still another aspect, the present disclosure provides a display apparatus. FIG. 11 shows a schematic diagram of a display apparatus including a display panel according to an embodiment of the present disclosure. Optionally, the display apparatus 1100 includes a display panel 1111. Optionally, the display panel 1111 is substantially the display panel 1000 disclosed in FIG. 10. Optionally, the display apparatus 1100 is one of electric paper, a smart phone, a tablet computer, a television, a displayer, a notebook computer, a digital picture frame, a navigator, or any product or component having a display function.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel-driving circuit comprising:

a driving sub-circuit coupled to a light-emitting device;

an initialization sub-circuit coupled to the light-emitting device, the initialization sub-circuit being configured to receive a scan signal and an initialization signal, and to initialize the light-emitting device with the initialization signal under control of the scan signal;

a data-input sub-circuit coupled to the driving sub-circuit, the data-input sub-circuit being configured to receive the scan signal and a data signal, and to write the data signal to the driving sub-circuit under control of the scan signal; and an emission-control sub-circuit coupled to the driving sub-circuit and the light-emitting device, the emission-control sub-circuit having two transistors of different types configured to receive a control signal and a reference-voltage signal, and to control the driving sub-circuit to output a driving current based on the data signal and the reference-voltage signal under control of the control signal.

2. The pixel-driving circuit of claim 1, wherein the emission-control sub-circuit comprises a first transistor, a second transistor, and a first capacitor;

the first transistor having a first control terminal configured to receive the control signal, a first terminal coupled to the driving sub-circuit, and a second terminal coupled to a first terminal of the first capacitor;

the second transistor having a second control terminal configured to receive the control signal, a first terminal configured to receive the reference-voltage signal, and a second terminal coupled to the first terminal of the first capacitor; and the first capacitor having a second terminal coupled to a first terminal of the light-emitting device which has a second terminal configured to connect with a second power supply.

3. The pixel-driving circuit of claim 2, wherein the driving sub-circuit comprises a driving transistor and a second capacitor;

the driving transistor having a control terminal coupled to a first terminal of the second capacitor and the first terminal of the first transistor;

the driving transistor having a first terminal coupled to the light-emitting device;

the driving transistor having a second terminal couple to a first power supply; and the second capacitor having a second terminal coupled to the first terminal of the first capacitor.

4. The pixel-driving circuit of claim 3, wherein the driving transistor is a N-type transistor.

5. The pixel-driving circuit of claim 3, wherein the data-input sub-circuit comprises a third transistor having a first terminal configured to receive the data signal, a second terminal coupled to the control terminal of the driving transistor, and a control terminal configured to receive the scan signal.

6. The pixel-driving circuit of claim 5, wherein the third transistor is a same type as the second transistor.

7. The pixel-driving circuit of claim 3, wherein the driving current is provided to be a driving-transistor factor multiplying a square of a voltage difference between an amplitude of the reference-voltage signal and an amplitude of the data signal, and to be substantially independent from a threshold voltage and a drain-terminal voltage of the driving transistor.

8. The pixel-driving circuit of claim 2, wherein the initialization sub-circuit comprises a fourth transistor having a first terminal configured to receive the initialization signal, a control terminal configured to receive the scan signal, and a second terminal coupled to the light-emitting device.

9. The pixel-driving circuit of claim 8, wherein the fourth transistor is a same type as the second transistor.

10. The pixel-driving circuit of claim 1, wherein the two transistors of different types are either N-type transistor or P-type transistor.

11. The pixel-driving circuit of claim 1, wherein an amplitude of the reference-voltage signal is set to be larger than a maximum value among amplitudes of different data signals received at various times.

12. A display panel comprising:

a plurality of scan lines;

a plurality of data lines;

a plurality of pixel-driving circuits according to claim 1, a respective one of the pixel-driving circuits coupled to a respective one of the scan lines to receive a scan signal and coupled to a respective one of the data lines to receive a data signal; and a light-emitting device having a first terminal coupled to the respective one of the pixel-driving circuits and a second terminal configured to connect with a second power supply.

13. A display apparatus comprising a display panel of claim 12.

14. A method for driving a pixel-driving circuit, the method comprising:

in a first period, writing voltages associated with a data signal and a reference-voltage signal respectively to a second capacitor under control of a scan signal and a control signal;

in a second period, writing voltages associated with the data signal, the reference-voltage signal, and a threshold voltage of a driving transistor to a first capacitor under control of the scan signal and the control signal; and in a third period, applying a combination of voltages associated with the data signal, the reference-voltage signal, and the threshold voltage of the driving transistor to across a gate terminal and a source terminal of the driving transistor under control of the control signal to provide a driving current from the driving transistor to a light-emitting device, the driving current being depended on the voltages associated with the data signal and the reference-voltage signal.

15. The method of claim 14 wherein, in a first period, writing voltages comprises:

turning a third transistor on under control of the scan signal to write a voltage associated with the data signal to a first terminal of the second capacitor;

turning a second transistor on under control of the control signal to write a voltage associated with the reference-voltage signal to a second terminal of the second capacitor; and turning a fourth transistor on under control of the scan signal to write a voltage associated with an initialization signal to a first terminal of the light-emitting device.

16. The method of claim 15, wherein the voltage associated with the initialization signal minus a voltage provided by a second power supply is set to be smaller than an emission-threshold voltage of the light-emitting device.

17. The method of claim 15, wherein the third transistor is a same type of transistor as the second transistor, the fourth transistor is a same type of transistor as the second transistor, and the first transistor is a different type of transistor as the second transistor.

18. The method of claim 14, wherein, in a second period, writing voltages comprises:

turning a first transistor off and a second transistor on under control of the control signal to write a voltage associated with the data signal minus the threshold voltage of the driving transistor to a second terminal of the first capacitor, a first terminal of the first capacitor being same as the voltage associated with the reference-voltage signal at the second terminal of the second capacitor; and charging the first terminal of the second capacitor to a first voltage depended to the voltage associated with the data signal.

19. The method of claim 14, wherein, in a third period, writing a combination of voltages comprises:

turning a first transistor on and a second transistor off under control of the control signal to short the second capacitor to induce a voltage change of both a first terminal and a second terminal of the second capacitor to a second voltage depended to a voltage associated with the data signal; and adding the voltage change to the second terminal of the first capacitor above the voltage associated with the data signal minus the threshold voltage of the driving transistor.

20. The method of claim 14, wherein the voltage associated with the reference-voltage signal comprises an amplitude greater than that of the voltage associated with the data signal.

* * * * *